United States Patent [19]

Bareis

[11] 4,305,414

[45] Dec. 15, 1981

[54] TENT HAVING A WATERPROOF FLOOR

[75] Inventor: Marvin A. Bareis, New Haven, Mo.

[73] Assignee: Kellwood Company, St. Louis, Mo.

[21] Appl. No.: 131,151

[22] Filed: Mar. 17, 1980

[51] Int. Cl.[3] ..... A45F 1/08

[52] U.S. Cl. ..... 135/1 R; 135/DIG. 1

[58] Field of Search ..... 135/DIG. 1, 1 R, 15 PE

[56] References Cited

U.S. PATENT DOCUMENTS

| | | | |
|---|---|---|---|
| 579,373 | 3/1897 | Wolbrecht | 135/DIG. 7 |
| 921,751 | 5/1909 | Strawn et al. | 135/DIG. 7 |
| 1,650,323 | 11/1927 | Byars | 135/DIG. 7 |
| 1,666,757 | 4/1928 | Snyder | 135/DIG. 7 |
| 1,820,412 | 8/1931 | Warren | 135/DIG. 7 |
| 2,627,864 | 2/1953 | Barker | 135/DIG. 7 |
| 3,874,396 | 4/1975 | Kirkham | 135/1 R |

FOREIGN PATENT DOCUMENTS

| | | | |
|---|---|---|---|
| 1142288 | 3/1957 | France | 135/DIG. 7 |
| 443728 | 3/1936 | United Kingdom | 135/DIG. 7 |
| 1104458 | 2/1968 | United Kingdom | 135/15 PE |

*Primary Examiner*—J. Karl Bell

*Attorney, Agent, or Firm*—Senniger, Powers, Leavitt and Roedel

[57] ABSTRACT

A tent comprising side walls which are inclined when the tent is erected, loops at the lower edges of the walls adapted to receive stakes driven into the ground, and a floor member of water impervious material comprising a floor panel adapted to lie on the ground when the tent is erected and sides extending up from the floor panel, the perimeter of the floor panel being spaced inwardly from the lower edges of the walls when the tent is erected, the sides of the floor member and the walls of the tent being sewn together at seams at the upper edge margins of the sides of the floor member, said seams being above the ground. Rings of elastic material are provided at the perimeter of the floor panel adapted to receive the stakes for holding the floor panel taut.

9 Claims, 5 Drawing Figures

TENT HAVING A WATERPROOF FLOOR

BACKGROUND OF THE INVENTION

This invention relates to tents, and more particularly to tents having a waterproof floor.

This invention is in the same general field as U.S. Pat. No. 1,650,323, British Pat. No. 443,728 and French Pat. No. 1,142,288 disclosing tents with floors, and involves improvements in tents of this type.

SUMMARY OF THE INVENTION

Among the several objects of the invention may be noted the provision of a tent having a floor member which, while being such as to form a water-tight enclosure, may be readily and easily spread flat on the ground and stretched taut; the provision of such a tent in which the floor is adapted to be held taut by means of the same stakes used for staking down the lower edges of the side walls of the tent; and the provision of such a tent in which the floor is maintained generally taut without the need for later adjustment.

Briefly, the tent of this invention comprises side walls which are inclined when the tent is erected, means at the lower edges of the walls adapted to receive stakes driven into the ground, and a floor member of water impervious material comprising a floor panel adapted to lie on the ground when the tent is erected and sides extending up from the floor panel, the perimeter of the floor panel being spaced inwardly from the lower edges of the walls when the tent is erected, the sides of the floor member and the side walls of the tent being sewn together at seams at the upper edge margins of the sides of the floor member, said seams being above the ground. Means is provided at the perimeter of the floor panel adapted to receive the stakes for holding the floor panel taut.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
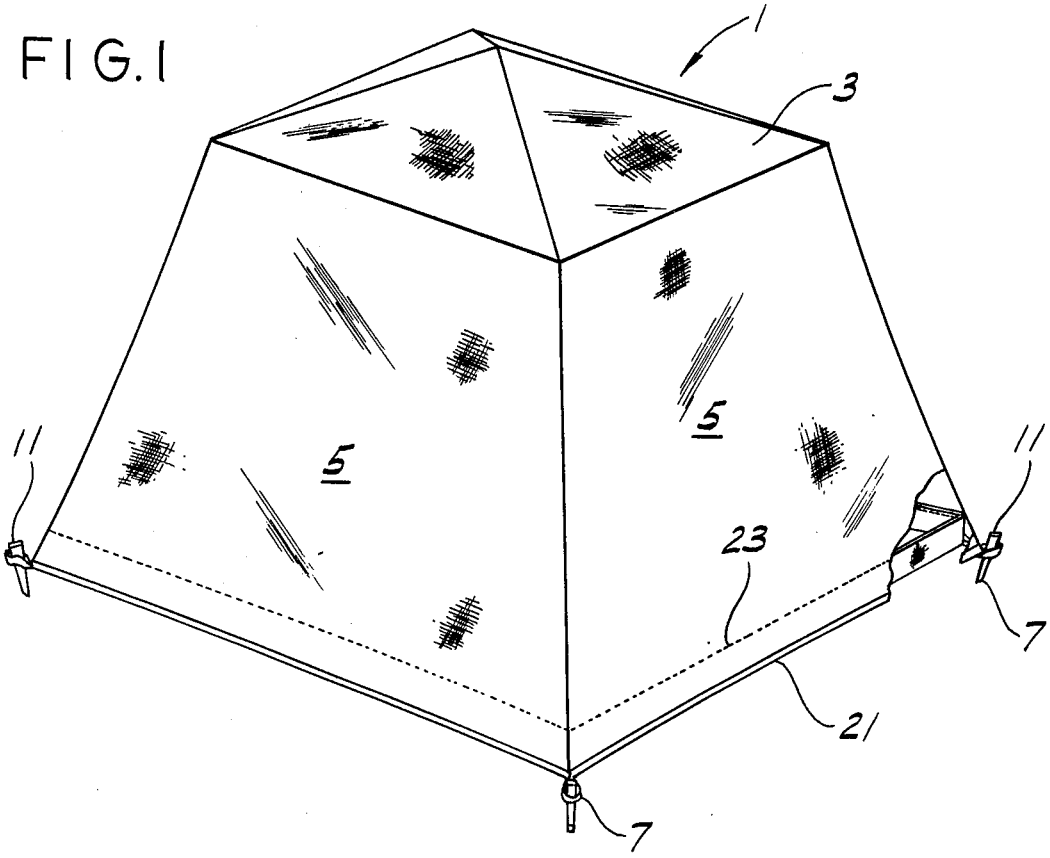
FIG. 1 is a perspective of a tent of the present invention in its erected position, a portion of a side wall at the lower right-hand corner of the tent being broken away to show interior detail.
Figure 3:
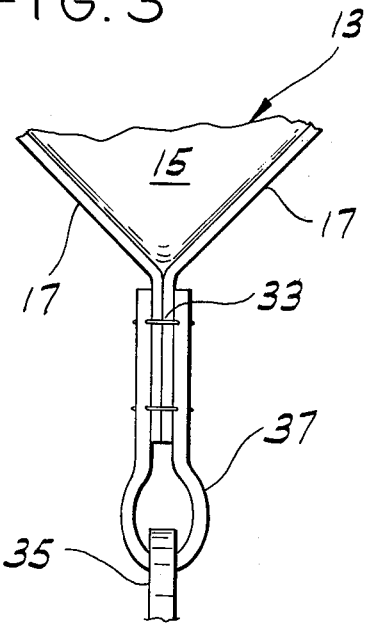
FIG. 3 is a horizontal section on line 3—3 of FIG. 2.
Figure 4:
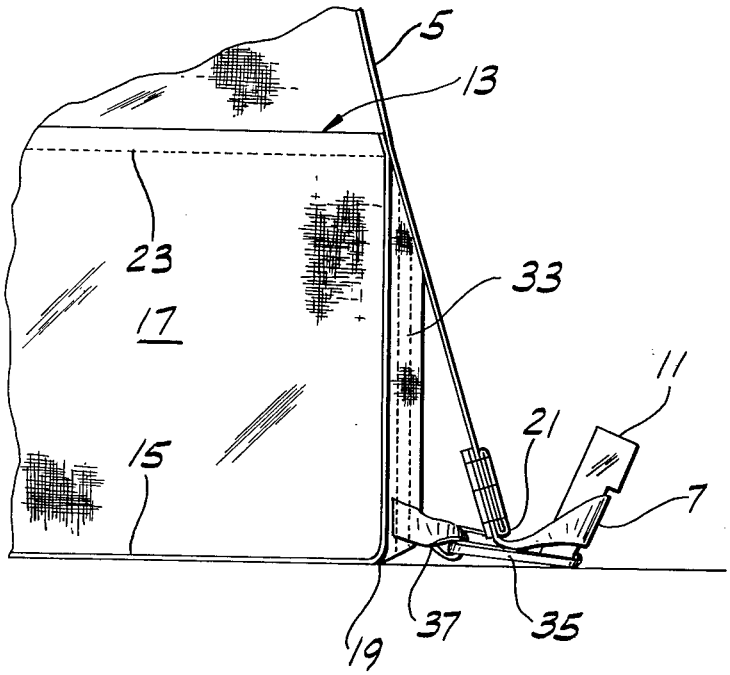
FIG. 4 is a vertical section on line 4—4 of FIG. 2.
Figure 2:
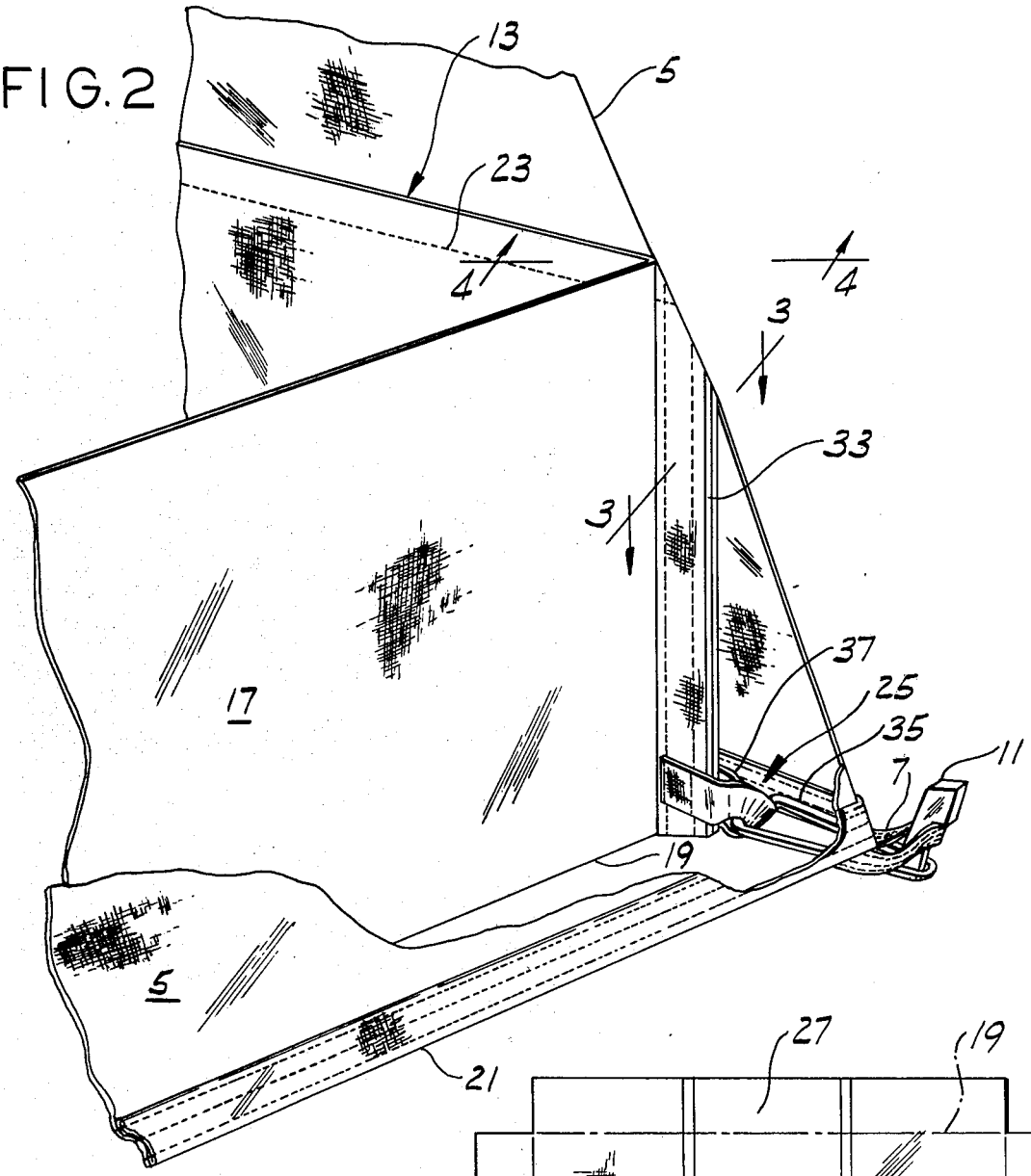
FIG. 2 is an enlarged perspective of the lower right-hand corner of the tent of FIG. 1.

Referring to FIG. 1 of the drawings, there is shown a tent 1 of this invention as it appears when erected. It comprises a roof 3 and four inclined side walls 5 of a suitable material such as a polyester and cotton fabric, a frame (not shown) being provided for holding it erect. The tent 1 further comprises means, such as loops 7 of fabric stitched to the side walls 5 at their lower edge margins at the four corners thereof adapted to receive stakes 11 driven into the ground, and a floor member of water impervious material designated in its entirety by the reference numeral 13. The floor member comprises a floor panel 15 adapted to lie on the ground when the tent is erected and sides 17 extending up (approximately six inches, for example) from the floor panel. The perimeter 19 of the floor panel is spaced inwardly from the lower edges 21 of the tent side walls 5 when the tent is erected, and the sides 17 of the floor member and the tent side walls are sewn together at seams 23 at the upper margins of the sides of the floor members, the seams being above the ground. Means 25 is provided at the perimeter 19 of the floor panel to receive the stakes 11 for holding the floor panel taut, whereby a tent floor free of undesirable wrinkles and bunched together portions is provided. With the tent erected, the floor, comprising panel 15 and sides 17, is in the form of a "tub", preventing entry of water on the ground into the tent even if the level of the water on the ground rises several inches.

Figure 5:
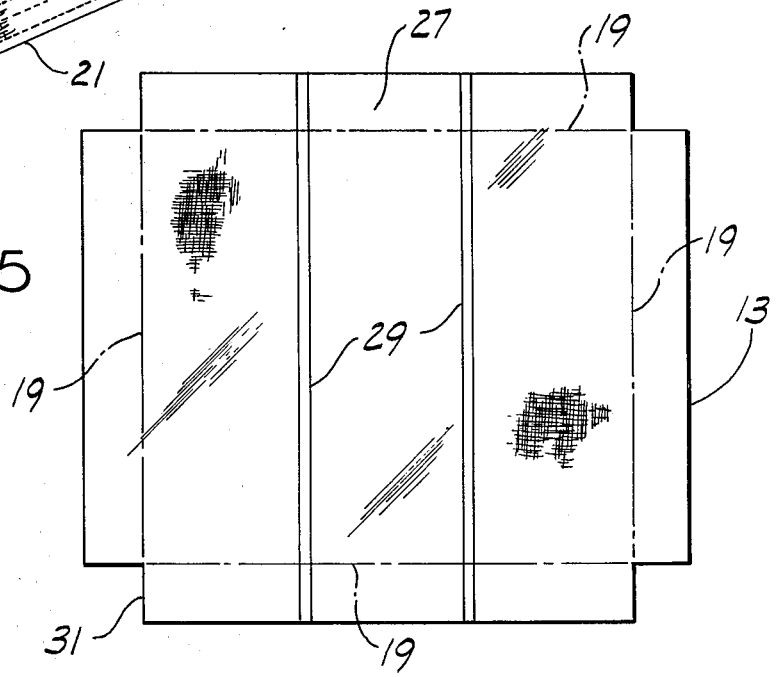
FIG. 5 is a plan of a blank of the sheet of material used to form the floor member of the tent.

Preferably, the floor member 13 is of a suitable heat-sealable, water impervious material, such as a vinyl-coated nylon which may be heat-sealed and stitched together to form waterproof seams. As shown in FIG. 5 a number of lengths of the material of available width may be sealed together at seams 29 to form a sheet 27 of sufficient width to form the floor member 13. The sheet 27 has notched corners 31 enabling the edge margins of the sheet to be folded up to form the sides 17 of the floor member, the sides being heat-sealed and sewn together at seams 33 at the vertical side edges of the floor member. It is contemplated that in lieu of heat-sealing the seams of the floor member 13, the seams may be sealed by applying a suitable sealant material between the overlapping portions of the sheet 27 at the seams and sewing these portions together.

The means 25 for holding the floor panel 15 taut comprises a plurality of elastic members such as rubber rings 35, each adapted to be stretched to receive the respective stake 11, attached by means of loops 37 of fabric stitched to the floor member in the seams 33 at the corners of the perimeter 19 of the floor panel and looped through a respective one of said rings 35. The rings of elastic material when in stretched condition apply tension to the floor panel to hold it taut.

While the tent 1 is shown to have four side walls 5, and a roof 3 and floor member 15 both having a generally square outline, it is contemplated that the tent may have any number of side walls and a floor member configured to have a side for each side wall of the tent. Moreover, while four stakes are provided for the tent 1, one at each of the four lower corners of the tent, it is contemplated that as many stakes may be used as may be required to hold the side walls of the tent to the ground or to hold the floor panel taut, a loop 7 on a tent side wall 5 and a ring 35 and a loop 37 on the floor member 13 being provided for each stake.

The erection of a tent of this invention is carried out in a manner substantially the same as that for a tent of similar design but without a floor member, the floor panel of the tent being stretched taut by stretching the elastic rings 35, lining them up with the loops 7 and driving the stakes 11 through the loops 7 and rings 35. The rings 35 then maintain the floor panel in taut condition without the need for later adjustment.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A tent comprising:

side walls which are inclined when the tent is erected;

means at the lower edges of the walls adapted to receive stakes driven into the ground;

a floor member of water impervious material comprising a floor panel adapted to lie on the ground when the tent is erected and sides extending up from the floor panel, the perimeter of the floor panel being spaced inwardly from the lower edges of the walls when the tent is erected, the sides of the floor member and the side walls of the tent being stitched together at seams at the upper edge margins of the sides, said seams being above the ground; and means at the perimeter of the floor panel adapted to receive the stakes for holding the floor panel taut comprising a plurality of elastic members each adapted to be stretched so as to receive the respective stake and, when stretched, to apply tension to the floor panel to hold it taut.

2. A tent as set forth in claim 1 wherein said means at the lower edges of the walls comprises a plurality of loops stitched to the walls at the lower edge margins thereof.

3. A tent as set forth in claim 2 wherein said loops are stitched to the walls at the lower corners of the tent.

4. A tent as set forth in claim 1 wherein each elastic member comprises a ring of elastic material.

5. A tent as set forth in claim 4 wherein the holding means further comprises a plurality of loops each stitched to the floor member at the perimeter of the floor panel and looped through a respective elastic ring.

6. A tent as set forth in claim 5 wherein said loops receiving said elastic rings are stitched to the floor member at the lower corners thereof.

7. A tent as set forth in claim 6 wherein the floor member is of a heat-sealable material, and wherein adjacent sides of the floor member are heat-sealed together to form seams at the vertically extending side edges of the floor member.

8. A tent as set forth in claim 1 wherein there are an equal number of tent side walls and sides of the floor member.

9. A tent as set forth in claim 8 having four side walls.

* * * * *